United States Patent [19]

Frohn

[11] Patent Number: 4,831,783

[45] Date of Patent: May 23, 1989

[54] METHOD AND APPARATUS FOR SURFACE GRINDING OF SMALL DIAMETER LONG BORE HOLES

[76] Inventor: Gunter Frohn, Giebelweg 12, 5990 Altena 7, Fed. Rep. of Germany

[21] Appl. No.: 144,245

[22] Filed: Jan. 14, 1988

[30] Foreign Application Priority Data

Jan. 17, 1987 [DE] Fed. Rep. of Germany ..... 3701219

[51] Int. Cl.[4] ..... B24B 5/40

[52] U.S. Cl. ..... 51/50 R; 51/48 R; 51/34 D; 51/67; 125/30 WD

[58] Field of Search ..... 51/67, 64, 60, 48 R, 51/59 R, 59 SS, 50 R, 290, 292, 328, 236, 165.93, 34 C, 34 D; 125/16 R, 30 WD

[56] References Cited

U.S. PATENT DOCUMENTS

| | | | |
|---|---|---|---|
| 925,233 | 6/1909 | Schmidmer | 51/67 |
| 2,047,055 | 7/1936 | Blood | 51/236 |
| 2,369,094 | 2/1945 | Weaver | 51/236 |
| 4,069,805 | 1/1978 | Sherman | 125/30 WD |

FOREIGN PATENT DOCUMENTS

| | | | |
|---|---|---|---|
| 0046437 | 11/1972 | Japan | 51/67 |
| 0290814 | 1/1971 | U.S.S.R. | 51/67 |

*Primary Examiner*—Frederick R. Schmidt
*Assistant Examiner*—Robert A. Rose
*Attorney, Agent, or Firm*—Collard, Roe & Galgano

[57] ABSTRACT

There is provided a method and apparatus for inside surface finishing with a high degree of dimensional accuracy and axial parallelism for long bores of very small diameter in work pieces. The method employs a high tensile strength steel wire as the grinding tool rotating at high speed under tension just below its yield strength. The wire is reciprocally moved back and forth in an axial direction and is coated with abrasive material. The work piece with the wire passing through its bore to be surface finished, is rotated eccentrically with respect to the wire and is axially parallel thereto. The inner wall of the bore is pressed against the wire which passes therethrough. The apparatus includes two clamping devices which reciprocally move back and forth together with a common base plate and which are rotated by synchronized drives. Between the two clamping devices the wire is stressed under tension, and a work piece holder which can be moved in a vertical direction transverse to the wire rotates the work piece.

5 Claims, 3 Drawing Sheets

METHOD AND APPARATUS FOR SURFACE GRINDING OF SMALL DIAMETER LONG BORE HOLES

The present invention relates to a method and apparatus for surface finishing small diameter long bore holes in work pieces by inner grinding the surfaces thereof.

For many industrial applications there is a need for long bore holes in work pieces having a very small diameter and a high degree of dimensional accuracy of the inner surface of the bore, as, for instance, in hard alloy cores for screw manufacture or in dies for extrusion molding for the manufacture of wheel stubs or similar products. In order to finish the surface in short bores in work pieces, a grinding technique can be used that employs a rotating pin, mounted at one end and having a cylindrical grinding head coated on its lateral surface. However, because of eccentricity around the grinding head, only relatively short work pieces can be operated on with adequate dimensional accuracy with such tools. The smaller the diameter of the bore to be surface finished, the shorter is the depth to which an exact surface finish is possible with such a tool. Thus, bores with a diameter of 10 mm can be surface finished accurately up to a length of 100 mm, with a diameter of 6 mm up to 60 mm, with a diameter of 2 mm up to 30 mm, with a diameter of 1 mm up to 20 mm, and with a diameter of 0.5 mm only up to 5 mm.

High dimensional accuracy of the inner surface of bores can be obtained by surface finishing on honing machines. The honing tool, fixed and driven at one end, can be expanded hydraulically in such a way that the honing stones lie with uniform pressure against the wall of the bore. While the tool rotates at high speed, the work piece or the honing tool is reciprocally moved back and forth axially. A disadvantage of the honing technique is the fact that the honing tool guides itself independently in the bore and adapts itself, therefore, to axial inaccuracies. Thus, in some cases an insufficient axial parallelism of the inner wall of the bores is achieved. Because of the type of tools required for such honing techniques their use is restricted to bores having relatively large inner diameters.

It is, therefore, the object of the present invention to provide a method and apparatus for grinding the inner surfaces of small diameter long bore holes in work pieces so that a high degree of dimensional accuracy and axial parallelism of the inner wall of the bore can be achieved.

The above object is accomplished in accordance with the present invention by employing a high tensile strength wire rotating at high speed as the grinding tool. The wire is stressed to just below its yield strength, is reciprocally moved back and forth in an axial direction and is coated with abrasive material. The work piece with wire passing through the bore to be surface finished is rotated eccentrically with respect to the wire and axially parallel thereto, with the inner wall of the bore pressed against the wire. For this technique steel wires with a tensile strength above 2100 Newton/square mm are used.

The above described method permits the inside grinding of bores of any length, especially of extremely small diameter, because the grinding tool used is a correspondingly high tensile strength wire of small diameter stressed to just below its yield strength. The alignment of the bore or its inner wall with the stressed wire results, with a corresponding set up of the work piece, in very highly accurate axial parallelism. Also, when using corresponding surface coatings or abrasive pastes for the wire, a high degree of dimensional accuracy results.

In order to employ this method a mechanism is proposed, consisting of two clamping devices with a common base plate which keep the wire under tension and which are reciprocally moved back and forth and simultaneously rotated by two synchronized drives. A work piece holder, movable transversely with respect to the wire, rotates the work piece. In such a mechanism, wires, put under tension and rotated, can be used as long grinding tools so that correspondingly long work pieces with inside bores can be surface finished.

The preferred apparatus consists of two clamping devices for the grinding tool wire, installed on a base plate spatially separated from one another with at least one of the clamping devices being movable. Between the two clamping devices a hydraulic cylinder is arranged in order to maintain tension on the wire. The work piece holder consists of two motor driven rollers aligned parallel with the stressed wire which serve as friction drives for the cylindrical work piece to be worked. The rollers are mounted on a support which can be accurately adjusted in a direction transverse to the wire. With respect to the clamping devices, one is installed on a sliding carriage that moves on the machine table together with its drive motor and the other is rigidly mounted on the base plate together with its drive motor. By using such apparatus, a cylindrical work piece, such as a hard alloy core, can be easily set up around the stressed grinding tool wire.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
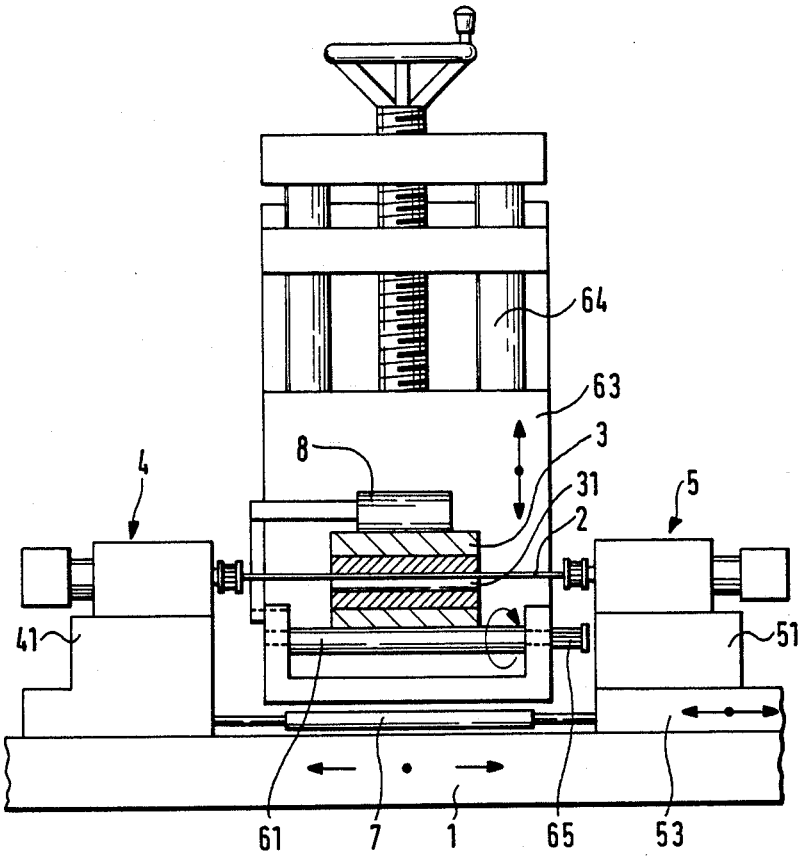
FIG. 1 is a diagramatic front elevational view of a mechanism employing the technique according to the present invention.
Figure 2:
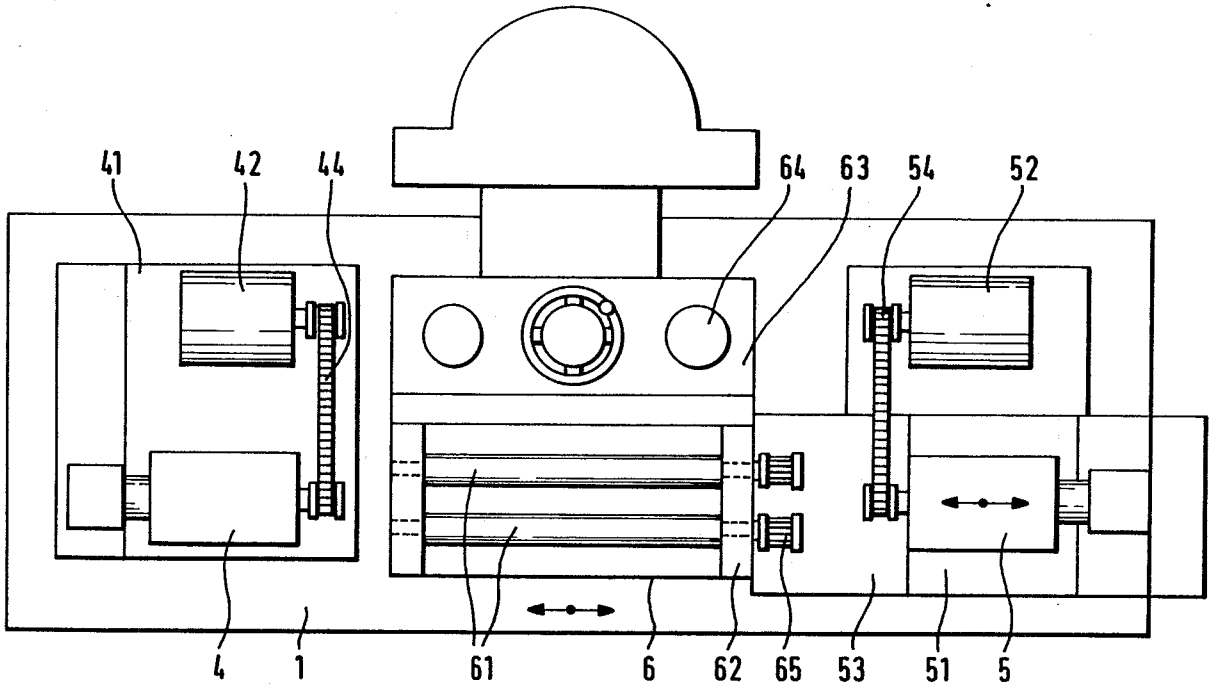
FIG. 2 is a plan view of the mechanism shown in FIG. 1.

Now turning to the drawings, there is shown in FIGS. 1 and 2 two clamping devices 4 and 5 installed at an adjustable distance from one another on a base plate which is adapted to reciprocally move back and forth. Between the clamping devices a high tensile strength wire 2, serving as a grinding tool, is kept under tension. The tension applied to the wire is just below the yield strength of the wire. Clamping device 4, together with its drive motor 42 and belt drive 44 and its support 41, is rigidly mounted on base plate 1. Second clamping device 5, together with its motor 52 and belt drive 54 and its support 51, is mounted on a sliding carriage 53 which moves on base plate 1. Between the two clamping devices 4 and 5 a pressure cylinder 7 is arranged which acts on supports 41 and 51 putting the stressed wire 2 under tension. The bearings of power rotated clamping devices 4 and 5 can accordingly take axial loads, as, for instance, so-called shoulder bearings.

Figure 3:
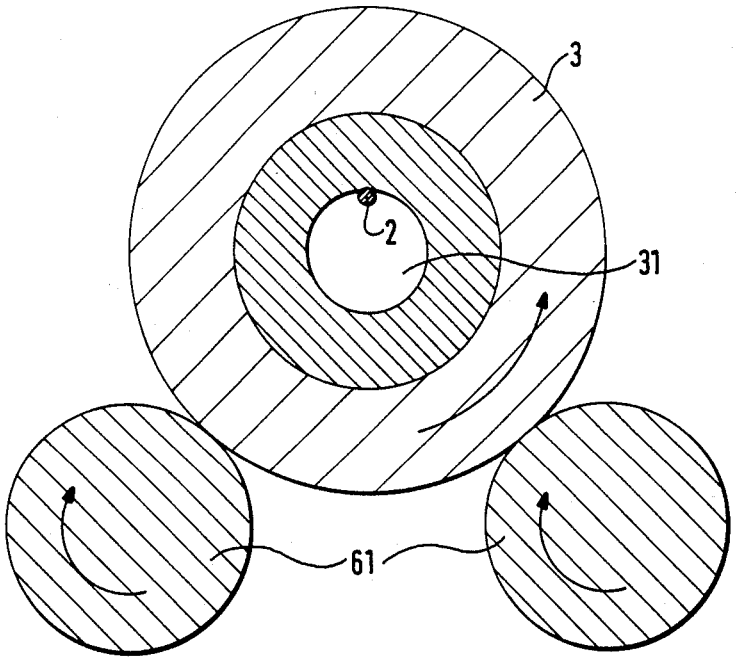
FIG. 3 is an enlarged cross-sectional view of the cylindrical work piece being worked in FIG. 1.

Work piece 3, such as, for example, a long hard alloy core, is set up with its bore 31 axially parallel to wire 2 which passes through bore 31, as clearly seen in FIG. 3. Work piece 3 rests on work piece holder 6 which comprises two rollers 61, axially parallel with wire 2, driven by belt drive 65 and mounted on support 62. Support 62 with a block 63 can be moved accurately in a vertical direction transverse to wire 2 along guides 64. Work piece 3 is rotated by rollers 61. During set up, the work piece holder is moved in relation to wire 2 in such a way that the inner wall of bore 31 of work piece 3 is pressed against wire 2. Wire 2 is maintained under tension and rotates together with its clamping devices 4 and 5 at high speed, such as 100,000 revolutions/minute. The wire itself is coated on its surface with diamond grains or an abrasive paste. Work piece 3 is arranged to rotate eccentrically with respect to wire 2, axially parallel to the wire which performs the surface finishing of the inner wall of bore 31. During the grinding process, wire 2, together with its clamping devices 4 and 5, is reciprocally moved back and forth by a corresponding power actuated movement of base plate 1. During working, work piece 3 can be pressed against wire 2 by a pressing roller 8.

When using the method according to the present invention in the apparatus described above, work pieces with long through bores of extremely small diameter can be surface finished on the inside. The diameter of the grinding wire is in each case adapted to the bore. Thus, for instance, bores with a diameter of 0.3mm can be surface finished with exact dimensional accuracy and axial parallelism for nearly any length.

When using the method according to the present invention, it is also possible to surface finish stepped bores by employing a correspondingly stepped grinding wire. In this case, the back and forth movement of the wire must be controlled accordingly.

Of special importance for the grinding apparatus according to the present invention is the precise synchronization of the two motor drives 42 and 52 of power rotated clamping devices 4 and 5.

While only a single embodiment of the present invention has been shown and described, it will be obvious that many changes and modifications may be made thereunto without departing from the spirit and scope of the invention.

I claim:

1. Apparatus for surface finishing the inner surfaces of long bores of small diameter in work pieces with a high degree of dimensional accuracy and axial parallelism, said apparatus comprising two spaced apart clamping devices, at least one of said clamping devices being movable so as to adjust the distance between the two clamping devices, a hydraulic pressure cylinder arranged between the clamping devices, a grinding tool in the form of a high tensile strength steel wire clamped in said clamping devices and maintained under tension by the action of said pressure cylinder on said clamping devices, a drive motor for each clamping device for rotating each clamping device in synchronization, a reciprocally movable common base plate on which are mounted said clamping devices for back and forth reciprocal movement thereof, a work piece holder vertically movable transversely to said wire, and means for rotating said work piece.

2. The apparatus according to claim 1, wherein said work piece holder comprises two motor driven rollers arranged parallel to the stressed wire and mounted on a support.

3. The apparatus according to claim 1, wherein said wire is coated with diamond grains or similar material.

4. The apparatus according to claim 1, wherein said wire is coated with an abrasive paste.

5. The apparatus according to claim 1, wherein one of said clamping devices is mounted together with its drive motor on a sliding carriage, said sliding carriage being arranged in such a way that it is movable on said base plate, and the other one of said clamping devices together with its drive motor is mounted rigidly on said base plate.

* * * * *